US012570419B2

(12) United States Patent
Freiberger

(10) Patent No.: US 12,570,419 B2
(45) Date of Patent: Mar. 10, 2026

(54) METHOD AND APPARATUS FOR FILLING AN OPEN CONTAINER

(71) Applicant: OPTIMA consumer GmbH, Schwäbisch Hall (DE)

(72) Inventor: Tobias Freiberger, Öhringen (DE)

(73) Assignee: OPTIMA conusmer GmbH, Schwäbisch Hall (DE)

( * ) Notice: Subject to any disclaimer, the term of this patent is extended or adjusted under 35 U.S.C. 154(b) by 0 days.

(21) Appl. No.: 18/842,349

(22) PCT Filed: Mar. 21, 2023

(86) PCT No.: PCT/EP2023/057227
§ 371 (c)(1),
(2) Date: Aug. 28, 2024

(87) PCT Pub. No.: WO2023/202832
PCT Pub. Date: Oct. 26, 2023

(65) Prior Publication Data

US 2025/0108944 A1 Apr. 3, 2025

(30) Foreign Application Priority Data

Apr. 19, 2022 (DE) ..... 102022203817.7

(51) Int. Cl.
*B65B 1/26* (2006.01)
*B65B 1/04* (2006.01)
(Continued)

(52) U.S. Cl.
CPC ..... *B65B 1/16* (2013.01); *B65B 1/28* (2013.01); *B65B 39/04* (2013.01)

(58) Field of Classification Search
CPC ..... B65B 1/28; B65B 25/001; B65B 39/04; B01D 19/0036
See application file for complete search history.

(56) References Cited

U.S. PATENT DOCUMENTS 831,527 A * 9/1906 Landsberger ..... B65B 31/025 53/85
2,578,815 A * 12/1951 Kronquest ..... B65B 31/022 53/76

(Continued)

FOREIGN PATENT DOCUMENTS

EP 0 257 683 A2 3/1988
GB 625903 A * 5/1946

(Continued)

OTHER PUBLICATIONS

International Search Report issued Sep. 12, 2023 in connection with PCT/EP2023/057227.

(Continued)

*Primary Examiner* — Stephen F. Gerrity
*Assistant Examiner* — David G Shutty
(74) *Attorney, Agent, or Firm* — Blank Rome

(57) ABSTRACT

The invention relates to a method and an apparatus for filling a container which is open at the top with a pourable product. A filling head is placed on the container. The container is received in a gas-tight sleeve which, at least in a filling position, adjoins the filling head and/or the container in a sealing manner to provide a gap between the sleeve and a container outer wall. For a product discharge, a reduced pressure up to a first pressure level is produced in the container and in the gap. After the product discharge is finished, a gas supply to the container and to the gap is carried out. Prior to the gas supply, a reduced pressure up to a second pressure level is produced, for a degassing of the container. The second pressure level is below the first pressure level.

12 Claims, 7 Drawing Sheets

(51) Int. Cl.

| | |
|---|---|
| ***B65B 1/16*** | (2006.01) |
| ***B65B 1/28*** | (2006.01) |
| ***B65B 31/02*** | (2006.01) |
| ***B65B 39/04*** | (2006.01) |

(56) References Cited

U.S. PATENT DOCUMENTS

RE23,504 E * 5/1952 Carter ..... B65B 39/04 141/7
2,815,621 A * 12/1957 Carter ..... B65B 1/26 53/436
2,954,203 A * 9/1960 Carter ..... G01G 13/00 141/51
3,220,153 A * 11/1965 Comack, Jr. ..... B67B 3/24 53/474
3,421,554 A 1/1969 Carter
3,605,826 A * 9/1971 Carter ..... B65B 31/025 141/93
4,154,044 A * 5/1979 Lang ..... B65B 31/025 53/97
4,825,913 A 5/1989 Stott
4,832,096 A * 5/1989 Kohlbach ..... B65B 39/04 141/114
4,976,296 A * 12/1990 Pope ..... B65B 39/04 141/46
5,234,037 A * 8/1993 Derby ..... B65B 1/26 222/394
5,244,019 A * 9/1993 Derby ..... B65B 1/26 222/452
5,279,339 A * 1/1994 Derby ..... B65B 1/26 141/73
5,402,918 A 4/1995 Nishiyama et al.
5,531,252 A * 7/1996 Derby ..... B65B 1/26 141/71
5,682,929 A * 11/1997 Maginot ..... B65B 43/56 141/10
5,791,123 A 8/1998 Bolz
6,220,310 B1 * 4/2001 Emmer ..... B67C 3/242 141/82
11,117,696 B2 * 9/2021 Scott ..... B65B 31/041
11,192,774 B2 * 12/2021 Tartler ..... B67D 7/645
11,597,550 B2 * 3/2023 Trautwein ..... B01D 39/12
2010/0012220 A1 * 1/2010 Waldron ..... B65B 39/08 141/10
2015/0266600 A1 * 9/2015 Haimi ..... B65B 31/046 53/404

FOREIGN PATENT DOCUMENTS

GB 754 795 A 8/1956
GB 786 368 A 11/1957
NZ 198 849 A 10/1985

OTHER PUBLICATIONS

Written Opinion of the International Searching Authority issued Sep. 12, 2023 in connection with PCT/EP2023/057227.

* cited by examiner

METHOD AND APPARATUS FOR FILLING AN OPEN CONTAINER

CROSS-REFERENCE TO RELATED APPLICATIONS

This application is a national phase of PCT/EP2023/057227, filed Mar. 21, 2023, and claims priority to German Patent Application No. 102022203817.7, filed Apr. 19, 2022, the entire contents of both of which are hereby incorporated by reference.

TECHNICAL FIELD AND PRIOR ART

The invention relates to a method and an apparatus for filling a container which is open at the top with a pourable or a powdered product by means of a reduced pressure which is produced in the container. The invention relates in particular to a method and an apparatus for filling a container which is open at the top with coffee powder or with milk powder by means of a reduced pressure which is produced in the container.

In the context of the application, filling a container by means of a reduced pressure which is produced in the container is also referred to as vacuum filling.

An apparatus and a method for vacuum filling containers which are open at the top is known, for example, from U.S. Pat. No. 3,605,826. The apparatus known from U.S. Pat. No. 3,605,826 comprises a filling head which can be placed on the container, a sleeve which for a filling operation surrounds the outer circumference of the container, and a sealing arrangement, wherein by means of the sealing arrangement, at least in a filling position of the filling head, an open end of the container is sealed with respect to the filling head and an upper end of a gap which is formed between the outer circumference of the container and the sleeve is sealed in a gas-tight manner. On the filling head there are provided a first opening and a second opening which are in each case covered with a screen and which are in each case connected by means of a valve which is referred to as a vacuum valve to a device for a pressure reduction and by means of a valve which is referred to as a pressure valve to a device for a pressure gas supply. Furthermore, two connection lines having valves are provided for a pressure reduction in the gap or a pressure gas supply to the gap. For a filling, a pressure is initially reduced in the container via the first opening and in the gap via the associated connection line. As soon as the pressure in the container has reached a predetermined value, a filling valve opens in a product supply line of the filling head over a predetermined period of time and a first predetermined quantity of the pourable product is introduced into the container. The filling valve and the vacuum valve of the first opening are then closed and the vacuum valve at the second opening is opened. At the same time, the pressure valve at the first opening is opened for a brief period of time so that the screen on the first opening is cleaned. After the pressure valve at the first opening has been closed again, there is a further pressure reduction in the container and the gap. As soon as the pressure reduction has reached a specific level, the filling valve is opened again. After a predetermined quantity of product has been introduced, the filling valve is closed again as is the vacuum valve at the second opening. The vacuum valve at the first opening and for a brief time the pressure valve at the second opening are opened so that the screen at the second opening is cleaned. These operations are repeated until a desired filling level in the container is reached. The filling valve and all the vacuum valves are then closed. The pressure valves in the filling head and the valve in the connection line for a pressure gas supply to the gap are opened in order to eliminate the reduced pressure in and around the container. Subsequently, the container and the sleeve are released from the filling head.

Problem and Solution

An object of the invention is to provide a method and an apparatus for filling a container which is open at the top with a pourable product, in particular with coffer powder or milk powder, by means of a reduced pressure which is produced in the container, which allow for a rapid and reliable filling process.

This object is achieved by the method and the apparatus having the features of claims 1 and 5. Advantageous embodiments are set out in the dependent claims.

According to a first aspect, a method is provided for filling a container which is open at the top with a pourable product, in particular with coffee powder or milk powder, using a filling head which is configured for being placed on the container in a gas-tight manner and which has a filling channel and a gas channel, wherein the container is received in a gas-tight sleeve which at least in a filling position adjoins the filling head and/or the container in a sealing manner in order to provide a gap between the sleeve and a container outer wall, which gap is closed in a gas-tight manner, wherein for a product discharge a reduced pressure up to a first pressure level is produced in the container and in the gap, wherein, after the product discharge is finished, a gas supply to the container and to the gap is carried out, wherein, for a degassing of the container, prior to the gas supply a reduced pressure up to a second pressure level which is below the first pressure level is produced, and wherein during the gas supply an inert gas is supplied at least to the container.

The terms “a”, “of a” or the like are used in connection with the application only as indefinite articles and not as numerals. The terms “first”, “second”, etcetera, serve only to differentiate and do not indicate any sequence. The use of the term “first” also does not necessarily require the presence of a second element or component.

The term “gas channel” in connection with the application is intended to refer to a gas-tight channel, wherein depending on the embodiment a gas removal or degassing of the container and the gap and a gas supply to the container and the gap is carried out via a single gas channel. To this end, the gas channel has one or more connection openings. In other embodiments, two gas channels or more than two gas channels for a gas removal from the container and the gap and a gas supply to the container and the gap are provided. The gas channel for a gas removal or degassing in this case is also referred to as a vacuum channel.

By applying the reduced pressure up to the second pressure level which is below the first pressure level, air which is present in the container after the filling process or another gas which is present in the filled container is removed. It has been the findings of the inventors that a degassing can advantageously follow a filling operation without changing an installation. In particular, it is advantageously possible to make use of the fact that the product as a result of the filling operation is in a loosened state so that in advantageous embodiments a degassing is possible in one step, instead of the usual plurality of steps with different pressure levels in conventional apparatuses for degassing.

Particularly when filling the container with food, chemical or pharmaceutical products, during the gas supply an inert gas, also referred to as a protective gas, for example, argon, carbon dioxide, nitrogen or a mixed gas, is supplied at least to the container in order to provide a protective gas atmosphere in the container. In an embodiment, an inert gas is also supplied in the gap so that, when the sleeve is removed, the container is surrounded by a protective gas atmosphere. After removing the sleeve, the container is in an embodiment transported to a closure device, wherein at least an upper region of the open container is retained in a protective gas atmosphere, for example, in a tunnel and/or in a laminar flow. In other embodiments, the filling head and the closure device are accommodated in a common housing or in housings which communicate with each other and in which there is a protective gas atmosphere.

The method thus enables a filling of the container and a gas exchange in the filled container in a compact apparatus.

According to an embodiment of the method, after the gas supply, a reduced pressure is applied at a gas-permeable portion of the filling channel, which gas-permeable portion adjoins the free end of the filling channel, so that the pourable product is drawn against an inner wall of the gas-permeable portion of the filling channel in order to form a bridge, wherein the reduced pressure is applied via the gas channel and/or via a chamber which surrounds the gas-permeable portion.

The term "bridge formation" in the context of the application refers to forming a stable arched structure in the region of an outlet opening of the filling channel as a result of adhesive forces between individual particles of the product. By applying a reduced pressure, after the gas supply a bridge formation is selectively caused, wherein by means of the bridge formation a locking action on the filling head is achieved so that filling valves, flaps or the like on the filling head can be dispensed with. An application of the reduced pressure is carried out in an embodiment via the gas channel which is used for degassing and gassing, wherein the reduced pressure is applied for a sufficiently short length of time so that a drawing of the product out of the container is at least reduced to a tolerable level. In an alternative embodiment, there is provided a chamber which surrounds the gas-permeable portion and via which at the gas-permeable portion a reduced pressure for a bridge formation can be applied. The chamber has in an embodiment a connection opening for a reduced pressure source, which is not in fluid communication with the gas channel. The chamber in this case is degassed or evacuated via the separate connection opening without the product being drawn out of the container via a container opening of the gas channel.

In an embodiment, prior to a gas supply, a pressure level in the container and in the gap is maintained at a constant pressure level for a setting of the product. It is thereby possible, during a subsequent degassing, for the air which is enclosed in the product to be not only removed from an upper region, but also from the lower regions of the container.

In an embodiment, an end of the gas channel, which end has a container opening, is immersed in the container in the filling position. In this case, an immersion depth determines a filling level in the container.

According to a second aspect, an apparatus for filling a container which is open at the top with a pourable product, in particular with coffee powder or with milk powder, is provided, comprising a filling head with a filling channel, which has a free end, and a gas channel, which has a container opening and a connection opening, a gas-tight sleeve, which is configured to receive the container in the filling position, wherein in a filling position gas can be removed from the container and gas can be supplied to the container via the gas channel, wherein the sleeve at least in the filling position adjoins the filling head and/or the container in a sealing manner in order to provide a gap which is closed in a gas-tight manner between the sleeve and a container outer wall, and wherein a gap connection opening is provided, wherein gas can be removed from the gap and gas can be supplied to the gap via the gap connection opening, and a control device, which is configured to fluidically connect the container and the gap to a reduced pressure source for a product discharge in such a manner that a reduced pressure up to a first pressure level can be produced in the container and the gap, which is configured to fluidically connect the container and the gap after a product discharge to a gas source in such a manner that a gas can be supplied to the container and the gap, and which is further configured, for a degassing which follows the product discharge, to fluidically connect, after the product discharge and prior to a gas supply, the container and the gap to the reduced pressure source in such a manner that a reduced pressure up to a second pressure level which is below the first pressure level can be produced in the container and the gap.

As set out above, the terms "a" "of a" or the like are in the context of the application used only as indefinite articles and not as numerals. In particular, in embodiments of the apparatus, more than one connection opening may be provided in the gas channel. Furthermore, in an embodiment, a multistage degassing with different pressure levels may be provided.

The control device is in an embodiment an electronic and/or pneumatic control device by means of which valves which are provided in the connection opening of the gas channel and in the gap connection opening can be opened or closed.

In other embodiments, a mechanical control device is provided. The mechanical control device comprises in an embodiment an actuation element which can be moved relative to the filling head, wherein depending on a positioning of the filling head relative to the actuation element the connection opening is fluidically connected to the reduced pressure source or to the gas source or separated therefrom and in particular closed. In an embodiment, the actuation element is an actuation disk which is provided on a rotary machine, wherein the filling head is moved along the circumference of the actuation disk. The use of a mechanical control device allows for a valve-free configuration for a gas removal and/or a gas supply.

In an embodiment, at least portion of the filling channel, which adjoins the free end, is configured in a gas-permeable manner. In an embodiment, the gas channel surrounds the gas-permeable portion so that, when a reduced pressure is produced in the gas channel, the pourable product can be drawn against an inner wall of this portion of the filling channel in order to form a bridge. Alternatively, in another embodiment, a chamber with a connection opening for a reduced pressure source is provided, which chamber surrounds the gas-permeable portion so that, when a reduced pressure is produced in the chamber, the pourable product can be drawn against an inner wall of the gas-permeable portion of the filling channel in order to form a bridge. To this end, the gas-permeable portion is made from a porous material in an embodiment. In advantageous embodiments, only the portion, which adjoins the free end, is configured in a gas-permeable manner in order to keep impairment of the filling operation as a result of a gas supply or gas removal via a wall of the filling channel low.

In an embodiment, a gas-permeable cover element for a product retention is provided at the container opening of the gas channel. For example, a grid element, a perforated element or a cover element made of a porous material is provided at the container opening.

In an embodiment, an end of the gas channel, which has the container opening, protrudes from a contact region of the filling head, which contact region can be connected to a container opening in a sealing manner, so that the end of the gas channel is introduced into the container in the filling position. In this case, an immersion depth of the gas channel determines a maximum filling level of the container.

In an embodiment, the sleeve can be moved relative to the filling head, wherein the sleeve in the filling position is moved toward the filling head and abuts it in a sealing manner. In other embodiments, the sleeve is formed integrally with the filling head. In this case, in an embodiment the sleeve and the filling head are produced separately from each other and connected to each other in a gas-tight manner. In other embodiments, the sleeve and the filling head are produced as an integral component.

In an embodiment, for a degassing and/or gassing of the gap, a separate reduced pressure source and/or a separate gas source is/are provided, wherein the gap can be fluidically connected to the separate reduced pressure source or the separate gas source by means of the gap connection opening. In other embodiments, the gap connection opening is fluidically communicated to the gas channel. In this case, the gap and the container can be fluidically connected by means of the gas channel to a common reduced pressure source or a common gas source.

In an embodiment, two reduced pressure sources are provided in order to produce a reduced pressure at a first pressure level and a reduced pressure at a second pressure level. In other embodiments, there is provision for the gas channel to have a bypass opening relative to an environment, wherein the control device is preferably configured in order to close the bypass opening for the degassing which follows the product discharge. By closing the bypass opening, it is thus possible, by means of the reduced pressure source used for the product discharge at the first pressure level, to produce a second pressure level for a degassing. In this instance, movable actuation elements such as throttles or the like can be dispensed with.

BRIEF DESCRIPTION OF THE DRAWINGS

Other advantages and aspects of the invention will be apparent from the claims and from the following description of embodiments, which are explained below with reference to the Figures. In the drawings:

DETAILED DESCRIPTION OF THE EMBODIMENTS

Figure 1:
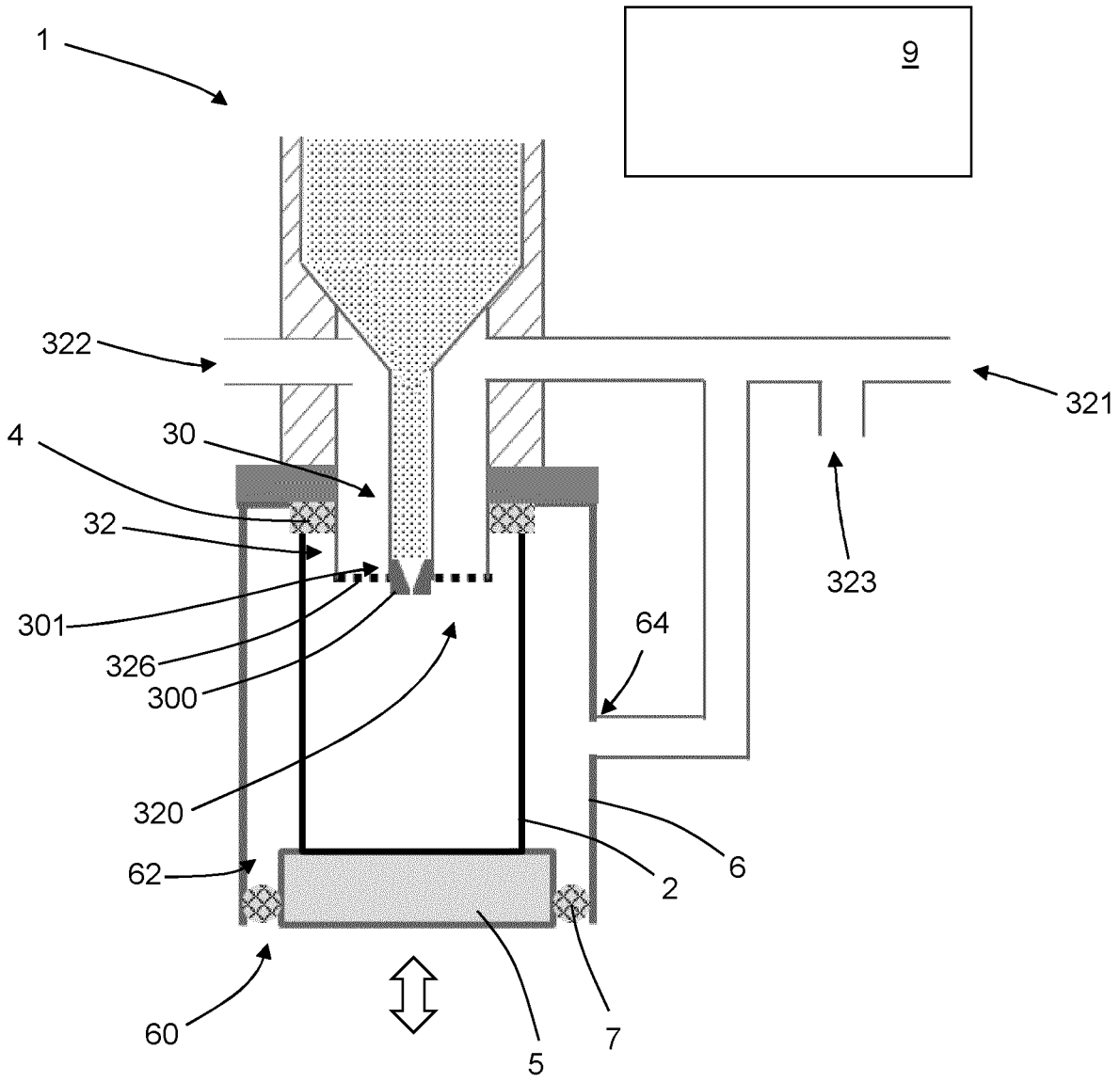
FIG. 1 shows an embodiment of an apparatus for filling a container which is open at the top with a pourable product.

FIG. 1 shows an embodiment of an apparatus 1 for filling a container 2 which is open at the top with a pourable product, in particular with coffee powder or with milk powder.

The apparatus 1 comprises a filling head 3 having a filling channel 30 with a free end 300 and a gas channel 32. The gas channel 32 comprises a portion which surrounds the filling channel 30 in an annular manner and at the free end of which a container opening 320 is provided. A gas-permeable cover element 326 for a product retention is provided at the container opening 320. The cover element 326 is, for example, a metal grid or a component made of a porous material.

The illustrated gas channel 32 further has a first connection opening 321 for connection to a reduced pressure source which is not illustrated and a second connection opening 322 for connection to a gas source which is not illustrated. Instead of the two connection openings 321, 322, in a modified embodiment only one connection opening is provided, which can be fluidically connected in a phase-dependent manner to the reduced pressure source or to the gas source. The gas channel 32 is further provided with a bypass opening 323 by means of which the gas channel 32 can be fluidically connected to an environment.

In a filling position illustrated in FIG. 1, the container 2 adjoins the filling head 3 in a gas-tight manner by means of a sealing element 4 so that gas can be removed from the container 2 via the gas channel 32. To this end, for example, the first connection opening 321 can be connected to a reduced pressure source which is not illustrated, such as a vacuum pump. Gas can also be supplied to the container 2 via the gas channel 32, wherein to this end the second connection opening 322 can be connected to a gas source which is not illustrated, in particular an inert gas supply.

Figure 10:
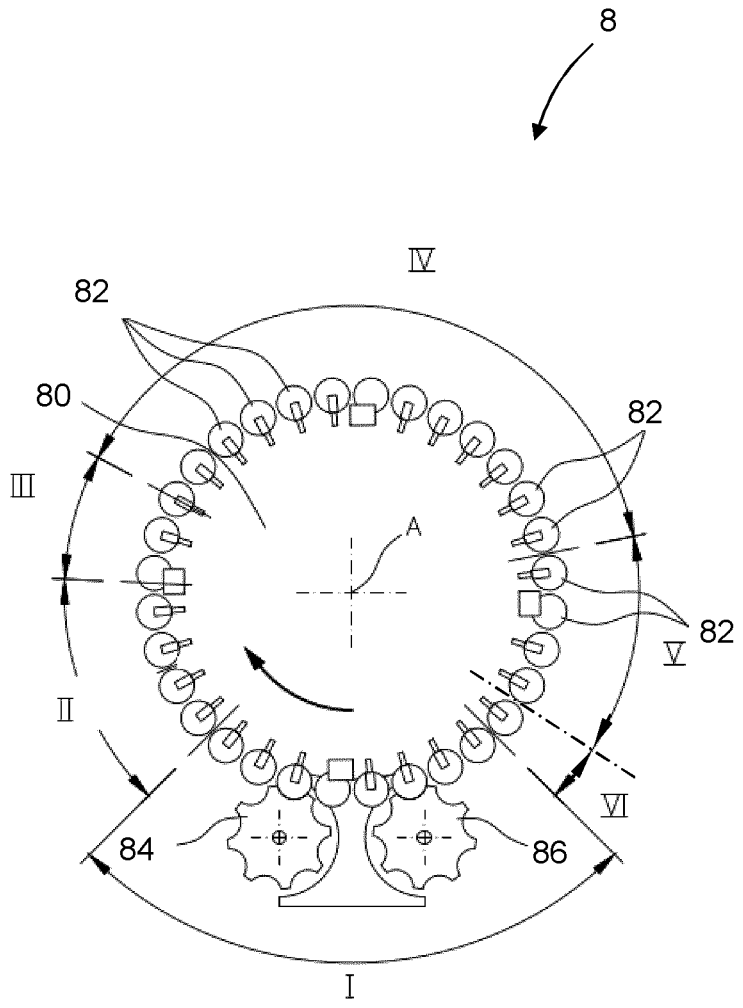
FIG. 10 shows a rotary machine having a plurality of apparatuses for filling containers.

For a movement of the container 2 relative to the filling head 3, in the embodiment illustrated, a platform 5 is provided, which supports the container 2 from below and which, as illustrated schematically by a double-headed arrow, can be moved relative to the filling head 3. In embodiments, the apparatus 1 is part of a rotary machine 8 which is illustrated in FIG. 10 and which has a plurality of positions 82, wherein the platform 5 is raised when the rotary machine 8 is rotated relative to the filling head 3 so that an upper open end of the container 2 abuts in a sealing manner against the filling head 3. In another embodiment, the filling head 3 is lowered relative to the platform 5 so that an upper open end of the container 2 abuts in a sealing manner against the filling head 3.

The apparatus 1 further comprises a gas-tight sleeve 6 which in the filling position illustrated in FIG. 1 receives the container 2. In the embodiment illustrated, the sleeve 6 is configured integrally with the filling head 3. The sleeve 6 in embodiments is manufactured as a separate component and connected to the filling head 3 in a gas-tight, unreleasable manner, for example, soldered thereto, adhesively bonded or welded, or connected to the filling head 3 in a gas-tight, releasable manner by means of sealing elements.

The sleeve 6 illustrated has an open lower end 60 which can be closed by means of the platform 5 in a gas-tight manner, for example, by means of a seal 7. A gap 62 is provided between the sleeve 6 and a container outer wall, which is closed in a gas-tight manner against the environment. In other embodiments, the sleeve 6 is configured integrally with the platform 5 and can be connected to the filling head 3 and/or the container 2 in a gas-tight, releasable manner.

The gap 62 is fluidically connected to the gas channel 32 by means of a gap connection opening 64 so that gas can be removed from the gap 62 and gas can be supplied to the gap 62 via the gap connection opening 64. The gap connection opening 64 is in other embodiments provided at the platform 5 and/or on a lid of the sleeve 6, which adjoins the filling head 3. The connection of the gap 62 to the gas channel 32 enables a simultaneous degassing and gassing of an interior of the container 2 and the gap 62 which surrounds the container 2 by means of a common reduced pressure source or a common gas source. In other embodiments, an additional reduced pressure source and/or an additional gas source is provided for the gap 62.

For a phased connection of the gas channel 32 to the reduced pressure source or the gas source, a control device 9 is provided.

In an embodiment, an electronic control device is provided. In this case, a connection of the gas channel 32 to the reduced pressure source or to the gas source is carried out by means of the electronic control device, by means of which valves which are provided in the connection openings 321, 322 can be opened or closed.

In other embodiments, a mechanical control device comprising an actuation disk is provided, wherein the actuation disk and the filling head can be moved relative to each other. Depending on a positioning of the filling head 3 relative to the actuation disk, by means of the actuation disk the connection openings 321, 322 are connected to the reduced pressure source or to the gas source or are separated therefrom and in particular are closed. In embodiments, the actuation disk is further configured in such a manner that, depending on positioning of the filling head relative to the actuation disk, the bypass opening 323 is opened for a fluid connection of the gas channel 32 to the environment or closed for a separation of the connection. The use of a mechanical control device allows a valve-free configuration for degassing and/or gassing.

In the embodiment illustrated, a portion 301 of the filling channel 30, which adjoins the free end 300 with the outlet opening, is configured in a gas-permeable manner so that, when a reduced pressure is produced in the gas channel 32, the pourable product can be drawn against an inner wall of this portion 301 of the filling channel 30 in order to form a bridge.

A method for filling the container 2 with the apparatus 1 is described below with reference to FIGS. 2 to 9.

Figure 2:
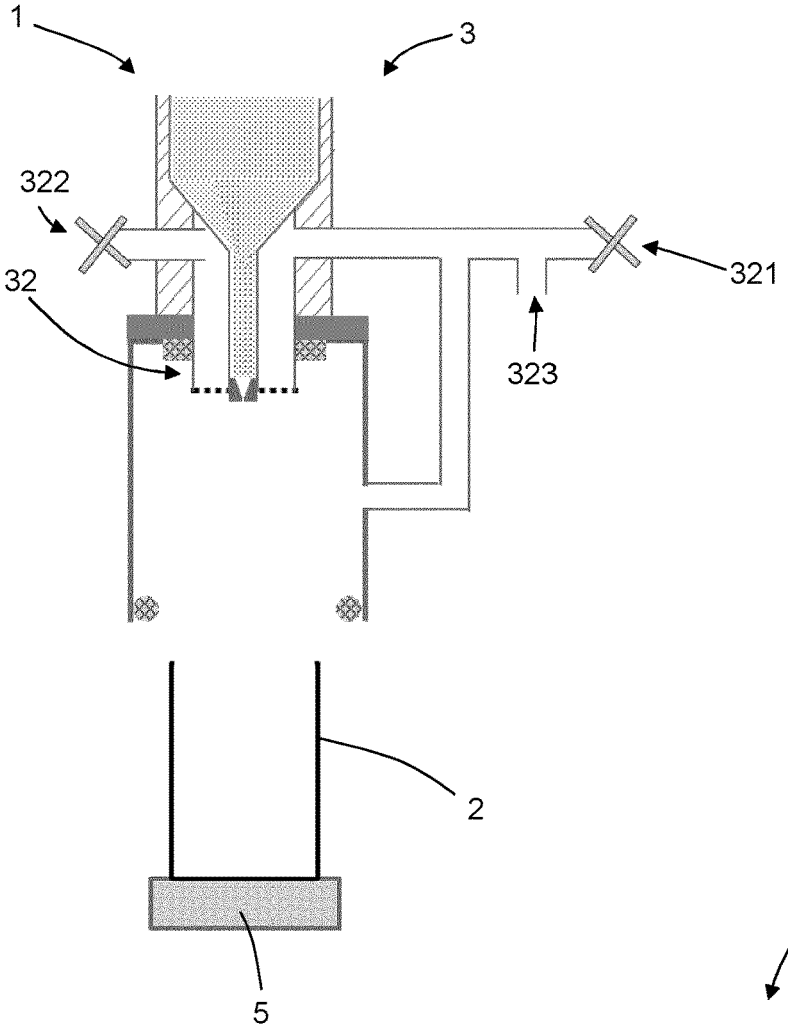
FIG. 2 shows a start position of a method for filling a container which is open at the top with a pourable product.

FIG. 2 shows a start position of the method, wherein the filling head 3 is arranged above the container 2 and with spacing therefrom. A connection to the reduced pressure source via the first connection opening 321 and a connection to the gas source via the second connection opening 322 are interrupted as illustrated schematically by means of crosses. The gas channel 32 may in this instance be connected to the environment by means of the bypass opening 323. In other embodiments, the connection is also interrupted.

Figure 3:
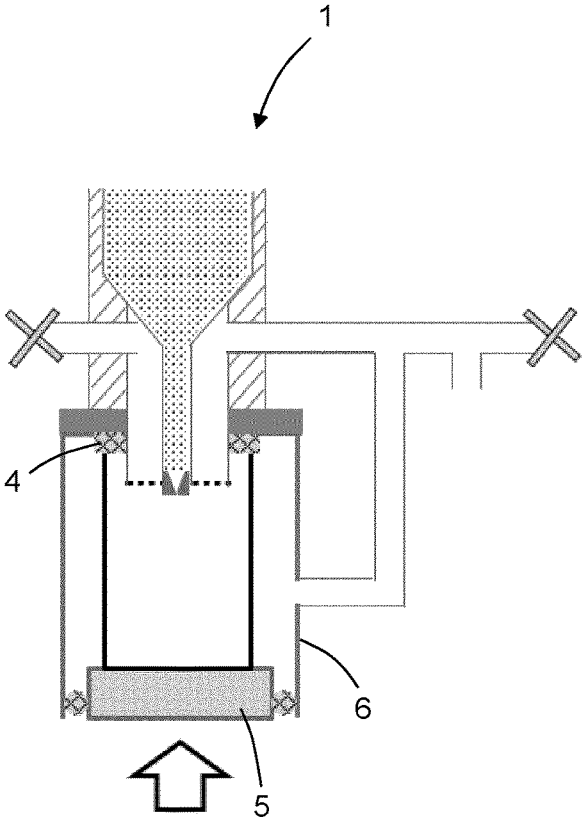
FIG. 3 shows a first phase of the method for filling the container which is open at the top, wherein the container is moved into a filling position.

FIG. 3 schematically shows a first phase of the method, wherein the container 2 is raised by means of the platform 5 in the direction of the filling head 3 and is moved into the filling position. In the filling position, the open end of the container 2 is closed in a gas-tight manner by means of the filling head 3. The container 2 is in this instance introduced into the sleeve 6 and the open lower end of the sleeve 6 is closed by means of the platform 5. In embodiments, the filling heads 3 is arranged at a constant height, wherein the movement of the platform 5 in the direction of the filling head 3 which is arranged at a constant height is advantageous for a simple configuration of the gas supplies and gas removals. However, embodiments in which the filling head 3 is lowered in the direction of the platform 5 are also conceivable.

Figure 4:
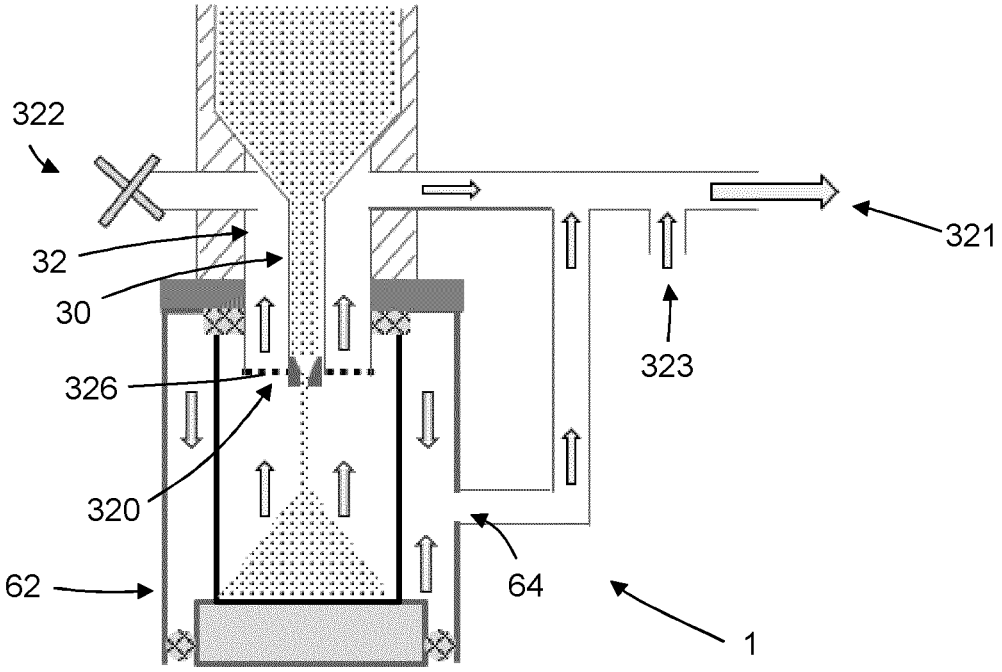
FIG. 4 shows a second phase of the method, wherein the container is filled.

FIG. 4 schematically shows a second phase of the method, wherein the container 2 is filled. To this end, the gas channel 32 is connected via the first connection opening 321 to a reduced pressure source which is not illustrated. By means of the reduced pressure source, a reduced pressure is produced in the container 2 and in the gap 62 via the container opening 320 of the gas channel 32 and via the gap connection opening 64. The connection of the gas channel 32 to the environment via the bypass opening 323 remains in this instance open so that a reduced pressure is produced at a first pressure level. The reduced pressure results in the pourable product being drawn via the filling channel 30 into the container 2. The gas-permeable cover element 326 on the container opening 320 prevents the product from reaching the gas channel 32.

Figure 5:
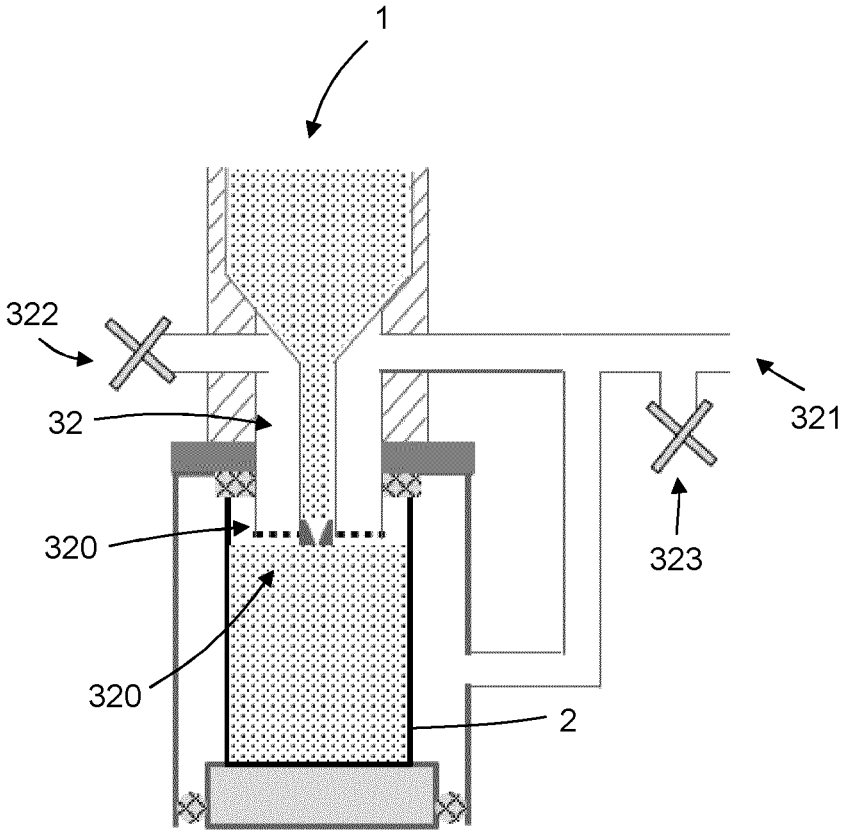
FIG. 5 shows a third phase of the method, wherein a pressure level is kept constant in order to settle the product.

FIG. 5 shows a third phase of the method after the product filling is complete, wherein a pressure level for setting the product in the container 2 is kept constant. The filling level in the container 2 is a result of an immersion depth of a free end of the gas channel 32, which has the container opening 320, into the container 2. In an embodiment, the connection opening 321 remains open during this phase. The bypass opening 323 is closed to prevent air or other gases from the environment from entering into the gas channel 32.

Figure 6:
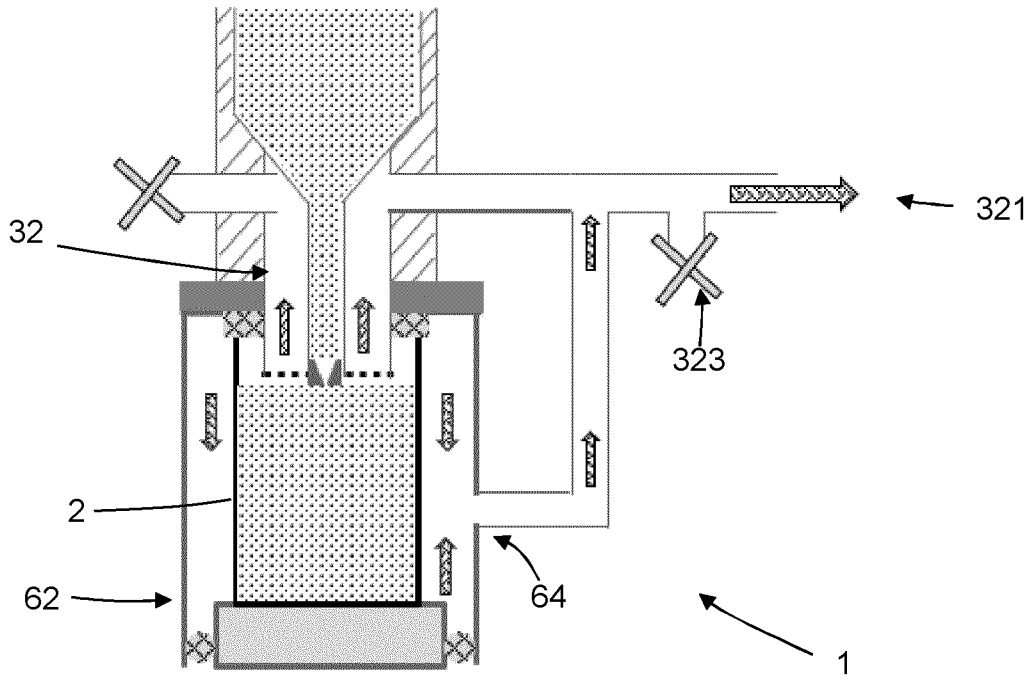
FIG. 6 shows a fourth phase of the method, wherein a pressure level is further reduced in order to degas the product.

FIG. 6 shows a fourth phase of the method, wherein a pressure level is further reduced for degassing the product poured into the container 2. To this end, in the embodiment illustrated the bypass opening 323 is closed so that, when the gas channel 32 is connected via the first connection opening 321 to the reduced pressure source, a second pressure level in the container 2 and in the gap 62 which surrounds the container is produced, which second pressure level is lower than the first pressure level during the product discharge (cf. FIG. 4). As a result of a simultaneous pressure reduction in the container 2 and in the gap 62 around the container 2, the container 2 is prevented from collapsing due to a reduced pressure being applied.

Figure 7:
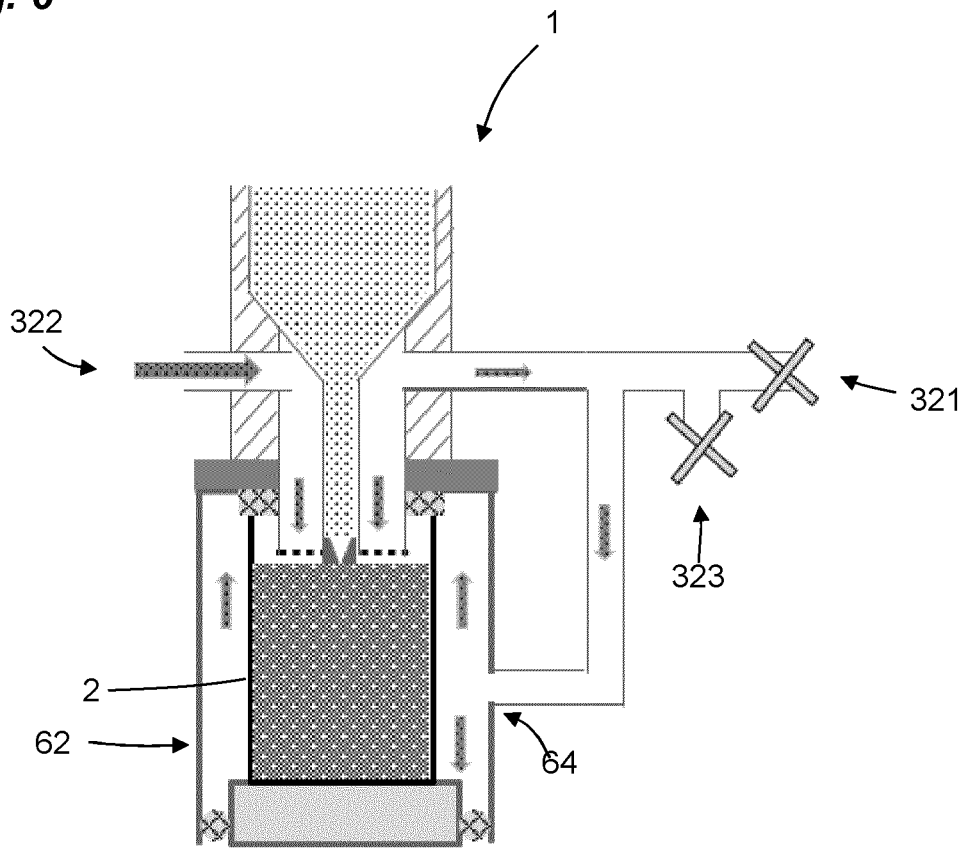
FIG. 7 shows a fifth phase of the method, wherein a gassing of the container is carried out with an inert gas.

FIG. 7 shows a fifth phase of the method, wherein a gassing of the container 2 is carried out with an inert gas. To this end, the first connection opening 321 is separated from the reduced pressure source and the second connection opening 322 is fluidically connected to the gas source. Since the gap 62 is fluidically connected to the gas channel 32 by means of the gap connection opening 64, the gap 62 is also gassed with the inert gas. In other embodiments, a different gas from the one in the container 2 is supplied to the gap 62 via a separate gas source.

Figure 8:
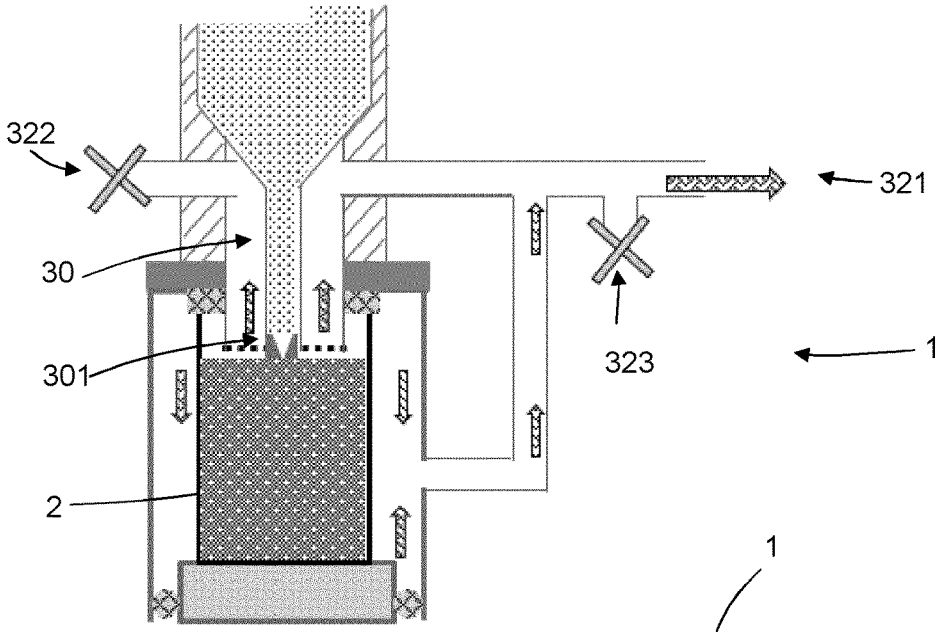
FIG. 8 shows a sixth phase of the method, wherein a bridge formation is carried out on a filling channel by applying a reduced pressure.

FIG. 8 shows a sixth phase of the method, wherein, in order to form a bridge at an outlet opening of the filling channel 30, a reduced pressure is applied again. To this end, the first connection opening 321 is again fluidically connected to the reduced pressure source. As a result of the reduced pressure applied, particles of the product present in the filling channel 30 are drawn against the gas-permeable portion 301 of the filling channel 30. Thereby, at the outlet opening of the filling channel 30 a so-called bridge is formed, which prevents further product discharge in the event of a separation of the container 2 from the filling head 3.

Figure 9:
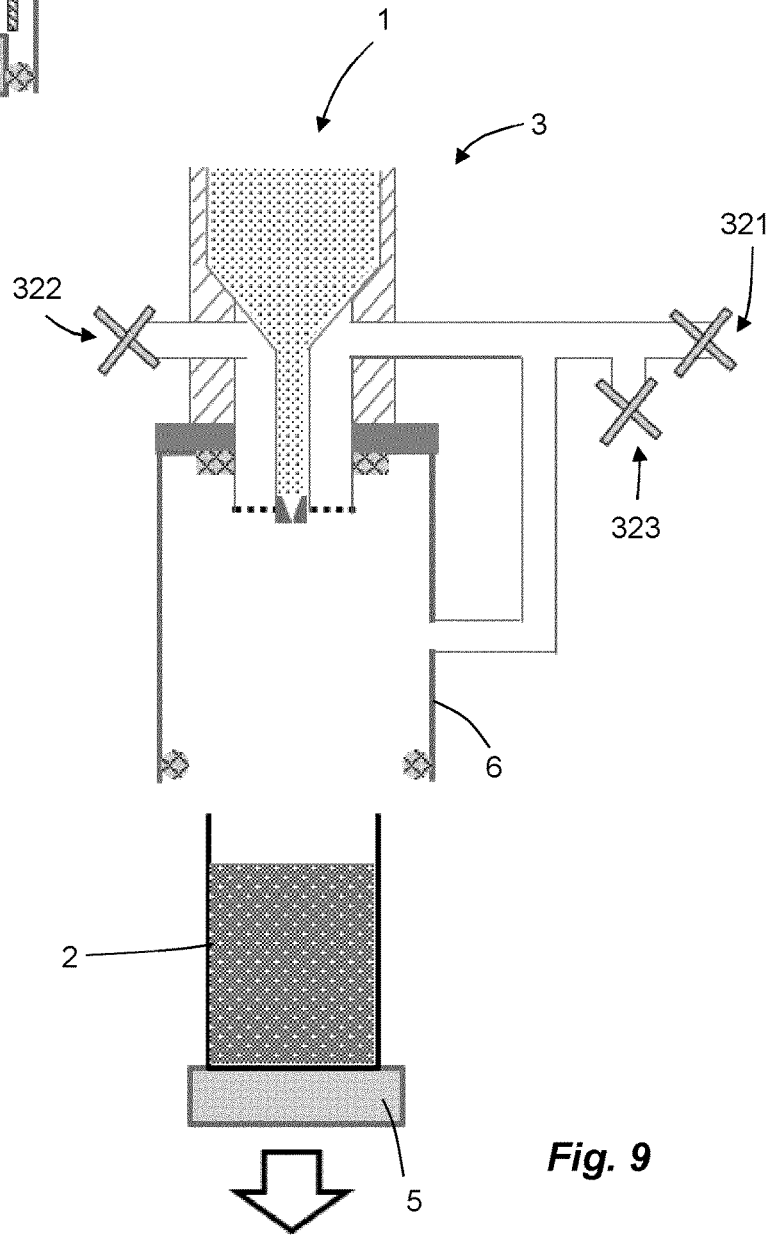
FIG. 9 shows a seventh phase of the method, wherein the container of the apparatus is removed.

FIG. 9 shows a seventh phase of the method, wherein the container 2 of the apparatus is removed. To this end, the platform 5 is lowered relative to the filling head 3 with the container 2 placed thereon. The container 2 can subsequently be supplied to a closure device which is not illustrated.

In advantageous embodiments, the apparatus 1 is at a position of a rotary machine having a plurality of positions each having an apparatus 1 according to FIGS. 1 to 9.

FIG. 10 schematically shows a rotary machine 8 as a plan view. The rotary machine 8 has a rotary disk 80 which rotates about a rotation axis A and a plurality of positions 82 which are distributed in a uniform manner over the circumference in the embodiment, wherein an apparatus 1 according to FIGS. 1 to 9 having a filling head 3 in each case is provided at each position 84. The rotary disk 80 can be rotated for a movement of the positions 82 in a timed manner or continuously about the rotation axis A. For loading and unloading, in the embodiment illustrated there are provided inlet and outlet wheels 84, 86 which rotate synchronously with the rotary machine 8 in order in each case to supply a container 2 (cf. FIGS. 1 to 9) to a position 82 or to remove a container 2 from a position 82. However, other devices for loading and unloading are also conceivable.

A rotary machine 8 enables a continuous process implementation, wherein the various process steps of the method according to FIGS. 2 to 9 can be carried out in a state distributed over the circumference of the rotary machine 8. In the embodiment illustrated, to this end six zones I to VI are provided on the rotary machine 8.

In a first zone I of the rotary machine 8, a loading or unloading of the rotary machine 8 is carried out with containers 2, wherein the containers 2 as illustrated in FIGS. 2 and 9 are raised in the direction of the filling head 3 or lowered relative thereto. The position 82 is in this instance closed with respect to the environment when the container 2 is raised in the direction of the filling head 3 by means of the sleeve 6 (cf. FIGS. 2 and 3) which can be connected in a sealing manner to the platform 5.

After loading, the containers 2 which are supplied to the rotary machine 8 are transported by rotating the rotary machine 8 and pass through additional zones, in the embodiment the zones II to VI.

In this instance, the containers 2 are first filled in the zone II as illustrated in FIG. 4. Subsequently, there is a settling of the filled product in zone III as schematically illustrated in FIG. 5. In zone IV, there is a degassing illustrated in FIG. 6. In a subsequent zone V, there is a gassing illustrated in FIG. 7 with an inert gas. Subsequently, in zone VI, as schematically illustrated in FIG. 8, in order to form a bridge 8 at an outlet opening of the filling channel 30 (cf. FIG. 8), a reduced pressure is applied again. Finally, the containers in the first zone I are disengaged and, for example, supplied to a closure device which is not illustrated in order to close the containers.

The rotary machine 8 also acts in this instance as a mechanical control device, wherein a fixed actuation disk which cannot be seen in FIG. 10 is provided on the rotary machine 8. With the rotation of the rotary disk 80 of the rotary machine 8, the apparatuses 1 provided at the positions 82 are moved relative to the actuation disk, wherein, depending on a positioning of the filling head 3 of the respective apparatus 1 relative to the actuation disk, the connection openings 321, 322 are connected to the reduced pressure source or to the gas source or are separated therefrom. The actuation disk is in this instance further configured in such a manner that, depending on a position of the filling head 3 relative to the actuation disk, the bypass opening 323 is opened for a fluidic connection of the gas channel 32 to the environment or is closed for a separation of the connection. The actuation disk, for a filling of the containers in zone II, results in a reduced pressure at a first pressure level being produced in the container 2 and the gap 62, and in zone IV for a degassing a reduced pressure up to a second pressure level below the first pressure level being produced in the container 2 and the gap 62.

Figure 11:
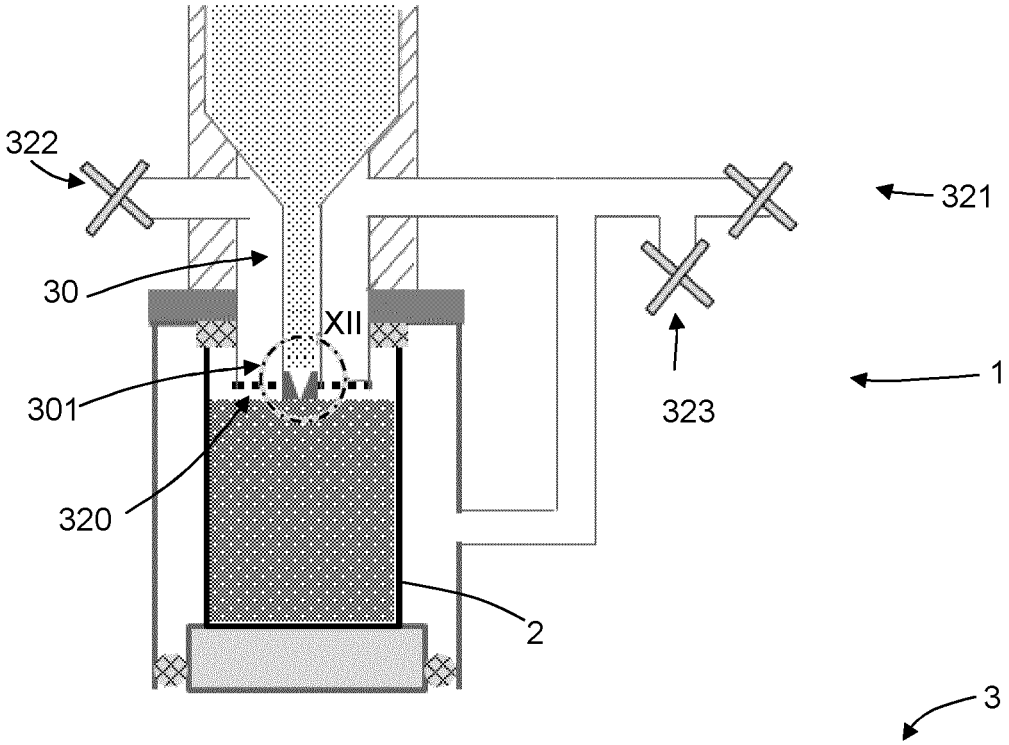
FIG. 11 shows a second embodiment of an apparatus for filling a container which is open at the top with a pourable product during the sixth phase of the method.
Figure 12:
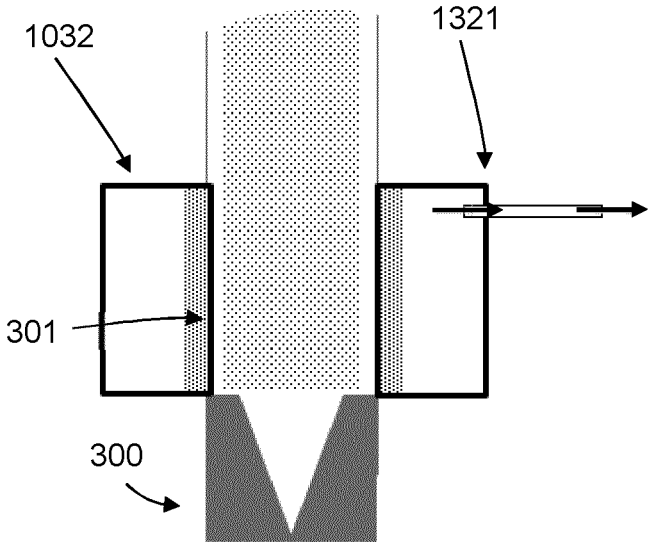
FIG. 12 shows a detail XII of the apparatus according to claim 11.

FIG. 11 shows a second embodiment of an apparatus 1 for filling a container 2, which is open at the top, with a pourable product during the sixth phase of the method according to FIG. 8. FIG. 12 shows a detail XII of the apparatus according to FIG. 11. The apparatus 1, which is illustrated in FIGS. 11 and 12, is similar to the apparatus 1 according to FIGS. 1 to 9 and uniform reference numerals are used for structurally identical or similar components. A repeated description of components which have already been described is omitted.

As can be seen in FIG. 12, in the embodiment according to FIGS. 11 and 12 a gas-tight chamber 1032 is provided, which gas-tight chamber 1032 has a connection opening 1321 for a reduced pressure source, which is not illustrated, and surrounds the gas-permeable portion 301 of the filling channel 30. In this embodiment, in the sixth phase of the method, a reduced pressure, which results in the pourable product being drawn against the inner wall of the gas-permeable portion 301 of the filling channel 30 in order to form a bridge, is produced only in the chamber 1032.

As illustrated in FIG. 11, in this instance the first connection opening 321 remains closed and/or separated from the reduced pressure source so that no suction of the product present in the container 2 via the container opening 320 is caused.

What is claimed is:

1. A method for filling a container which is open at the top of the container with a pourable product, comprising the following steps:

using a filling head, wherein the filling head is configured for being placed on the container in a gas-tight manner, wherein the filling head has a filling channel and a gas channel, receiving the container in a gas-tight sleeve, wherein the gas-tight sleeve at least in a filling position adjoins the filling head and/or the container in a sealing manner in order to provide a gap between the sleeve and a container outer wall, and wherein the gap is closed in a gas-tight manner;

producing a reduced pressure up to a first pressure level in the container and in the gap for a product discharge; and after the product discharge is finished, carrying out a gas supply to the container and to the gap, wherein during the gas supply an inert gas is supplied at least to the container;

prior to the gas supply, producing a reduced pressure up to a second pressure level, wherein the second pressure level is below the first pressure level for a degassing, wherein air or another gas which is present in the container after the product discharge is removed.

2. The method for filling as claimed in claim 1, wherein, after the gas supply, a reduced pressure is applied at a gas-permeable portion of the filling channel, wherein the gas-permeable portion adjoins a free end of the filling channel, so that the pourable product is drawn against an inner wall of the gas-permeable portion in order to form a bridge, wherein the reduced pressure is applied via the gas channel and/or via a chamber which surrounds the gas-permeable portion.

3. The method for filling as claimed in claim 1, wherein, prior to the gas supply, a pressure level in the container and in the gap is maintained at a constant pressure level for a setting of the product.

4. The method for filling as claimed in claim 1, wherein an end of the gas channel is immersed in the container in the filling position, wherein the end has a container opening.

5. An apparatus for filling a container which is open at the top of the container with a pourable product, comprising:

a filling head with a filling channel which has a free end and a gas channel which has a container opening and a connection opening, wherein the filling head is configured such that, in a filling position, gas is removable from the container and gas is suppliable to the container via the gas channel, a gas-tight sleeve which is configured to receive the container in the filling position, wherein the sleeve at least in the filling position adjoins the filling head and/or the container in a sealing manner in order to provide a gap between the sleeve and a container outer wall, wherein the gap is closed in a gas-tight manner, and wherein a gap connection opening is provided, wherein the gap connection opening is configured such that gas is removable from the gap and gas is suppliable to the gap via the gap connection opening, and a control device, which is configured to fluidically connect the container and the gap to a reduced pressure source for a product discharge in such a manner that a reduced pressure up to a first pressure level is produced in the container and the gap, and to fluidically connect the container and the gap for a gas supply after the product discharge to a gas source in such a manner that a gas is supplied to the container and the gap, wherein during the gas supply an inert gas is supplied at least to the container, and to fluidically connect, after the product discharge and prior to the gas supply, the container and the gap for a degassing to the reduced pressure source in such a manner that a reduced pressure up to a second pressure level is produced in the container and the gap, wherein the second pressure level is below the first pressure level, wherein air or another gas which is present in the container after the product discharge is removed.

6. The apparatus for filling as claimed in claim 5, wherein at least a portion of the filling channel, which adjoins the free end, is configured in a gas-permeable manner, wherein the gas channel surrounds a gas-permeable portion so that, when a reduced pressure is produced in the gas channel, the pourable product is drawn against an inner wall of the gas-permeable portion of the filling channel in order to form a bridge, and/or wherein a chamber having a connection opening for a reduced pressure source is provided, wherein the chamber surrounds the gas-permeable portion so that, when a reduced pressure is produced in the chamber, the pourable product is drawn against an inner wall of the gas-permeable portion of the filling channel in order to form the bridge.

7. The apparatus for filling as claimed in claim 5, wherein a gas-permeable cover element for a product retention is provided at the container opening of the gas channel.

8. The apparatus for filling as claimed in claim 5, wherein an end of the gas channel, which has the container opening, protrudes from a contact region of the filling head, wherein the contact region is configured to connect to the container opening in a sealing manner, so that the end of the gas channel is introduced into the container in the filling position.

9. The apparatus for filling as claimed in claim 5, wherein the sleeve is formed integrally with the filling head.

10. The apparatus for filling as claimed in claim 5, wherein the gap connection opening is fluidically connected to the gas channel.

11. The apparatus for filling as claimed in claim 5, wherein the gas channel has a bypass opening to an environment.

12. The apparatus for filling as claimed in claim 11, wherein the control device is configured to close the bypass opening for the degassing which follows the product discharge.

* * * * *